US009334600B2

(12) United States Patent
Pollett et al.

(10) Patent No.: US 9,334,600 B2
(45) Date of Patent: May 10, 2016

(54) FABRIC SOFTENER SENSING AND REUSE OF GREY WATER FROM THE RINSE CYCLE OF A WASHING MACHINE

(75) Inventors: James Quentin Pollett, Louisville, KY (US); Matthew David Mersch, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1157 days.

(21) Appl. No.: 13/090,661

(22) Filed: Apr. 20, 2011

(65) Prior Publication Data

US 2012/0266388 A1 Oct. 25, 2012

(51) Int. Cl.

| | |
|---|---|
| ***D06F 33/00*** | (2006.01) |
| ***D06F 39/00*** | (2006.01) |
| ***D06F 33/02*** | (2006.01) |
| ***D06F 35/00*** | (2006.01) |

(52) U.S. Cl.

CPC ..... *D06F 39/006* (2013.01); *D06F 33/02* (2013.01); *D06F 35/006* (2013.01); *D06F 39/004* (2013.01)

(58) Field of Classification Search

CPC ..... D06F 39/006; D06F 39/02; D06F 39/004; D06F 33/006; D06F 33/02; D06F 3/006; D06F 33/0255

USPC ..... 8/137; 68/12.18

See application file for complete search history.

(56) References Cited

U.S. PATENT DOCUMENTS

| | | | | |
|---|---|---|---|---|
| 5,715,555 | A * | 2/1998 | Reber | A47L 15/4295 68/12.02 |
| 5,868,937 | A * | 2/1999 | Back | A47L 15/4291 210/167.31 |
| 7,000,437 | B2 | 2/2006 | Raney et al. | |
| 7,927,494 | B2 * | 4/2011 | Ikematsu | D06F 39/006 210/681 |
| 8,246,756 | B2 * | 8/2012 | Hendrickson et al. | 134/18 |
| 2006/0123563 | A1 * | 6/2006 | Raney | A47L 15/42 8/158 |

FOREIGN PATENT DOCUMENTS

| | | | |
|---|---|---|---|
| DE | 3805565 | A1 * | 8/1989 |
| DE | 102007041069 | A1 * | 3/2009 |
| EP | 1632598 | A2 * | 3/2006 |
| WO | WO 2008155755 | A4 * | 2/2009 |
| WO | WO 2010105937 | A1 * | 9/2010 |

OTHER PUBLICATIONS

Machine translation of DE3805565A1, dated Aug. 1989.*
Machine translation of WO 2010105937 A1, dated Sep. 2010.*
Machine translation of DE 102007041069 A1, dated Mar. 2009.*

* cited by examiner

*Primary Examiner* — Joseph L Perrin
*Assistant Examiner* — Kevin G Lee
(74) *Attorney, Agent, or Firm* — Dority & Manning, P.A.

(57) ABSTRACT

The capture and reuse of the effluent, or grey water, from the rinse cycle of a washing machine appliance is provided. A determination is made regarding whether fabric softener is present in the effluent. If fabric softener is present, then the effluent can be reused during a rinse cycle of the washing machine so as to avoid undesirable interaction between the fabric softener in the effluent and the detergent of a rinse cycle.

7 Claims, 6 Drawing Sheets

FABRIC SOFTENER SENSING AND REUSE OF GREY WATER FROM THE RINSE CYCLE OF A WASHING MACHINE

FIELD OF THE INVENTION

The present invention relates to the capture and reuse of the effluent, also known as grey water, from the rinse cycle of a washing machine appliance.

BACKGROUND OF THE INVENTION

Water is a critical natural resource for which demand is high. In addition to clean water for consumption, there is a need for the conservation of water as demand on available resources continues to grow. As such, products which contribute to the recycling and conservation of water resources are desirable to certain consumers and may be required by legislation.

The washing machine is an appliance that is commonly found in residential and commercial settings and which typically uses water to properly clean articles such as e.g., clothes, linens, towels, and other machine washable items. A detergent, generally one that contains surfactants and possibly brighteners as well, is added to the water for cleaning. A fabric softener may be used during a rinse cycle for purposes of softening the washed articles, controlling static cling, and adding a scent to the articles. For certain applications, it can be desirable to recycle the water effluent from a washing machine. More particularly, water from the wash cycle, rinse cycle, or combinations thereof can be recycled by using such water again in the washing machine.

Grey water is the effluent from a washing machine appliance that was used during a cycle in the washing machine. For example, grey water is created during a wash cycle. The water that is used for washing clothes or other articles will eventually come to contain e.g., detergent and other matter released from the clothes during the washing process. Grey water is also created during the rinse cycle. Water that is added to the clothes during the rinse cycle will also eventually contain e.g., detergent that is released during the rinse and/or spin process. If fabric softener is applied during the rinse cycle, then the grey water can also contain residual fabric softener as well as precipitates formed by the interaction of the detergent and fabric softener.

While grey water from a rinse cycle may be reused in a washing machine, the presence of fabric softener in such water can cause certain problems. Typically, the detergents that are used during the wash cycle of washing machine will contain surfactants. These surfactants affect the surface tension of the water and allow soil to be removed from the clothes, improve the wetting ability of the water, and help suspend soils in the water. Most commonly available laundry detergents use anionic type surfactants, which carry a negative charge. Commonly available fabric softeners also use surfactants, but their surfactants are cationic—i.e., carry a positive charge.

When a washing machine is operated with fabric softener, the fabric softener is typically added during the last rinse cycle. While a portion of the cationic surfactants of the fabric softener may be used during the rinse cycle, some will likely remain in the water at the end of the cycle. Accordingly, if grey water from the rinse cycle is to be reused in the washing machine, it is preferable that the cationic surfactants present in the grey water are not mixed with anionic surfactants from the detergent. Such mixing of the two differently charged surfactants can reduce the cleaning effectiveness of the detergent and form unwanted precipitates in the water, which in turn can form a residue on the articles being washed and the components of the washing machine.

Accordingly, a washing machine that can reuse grey water would be beneficial. More particularly, a washing machine that can reuse effluent or grey water from the rinse cycle, which may contain fabric softener, would be useful. Such a washing machine that can also determine whether fabric softener is present in the grey water from a rinse cycle would also be beneficial.

BRIEF DESCRIPTION OF THE INVENTION

Aspects and advantages of the invention will be set forth in part in the following description, or may be obvious from the description, or may be learned through practice of the invention.

In one exemplary aspect, the present invention provides a method for operating a washing machine that include the steps of capturing effluent from a rinse cycle of a washing machine; determining whether the effluent contains fabric softener; and, using the effluent in another rinse cycle of the washing machine if fabric softener is present.

In another exemplary embodiment, the present invention provides a washing machine that includes a wash chamber for containing articles to be washed and an agitation device present in the wash chamber for moving the articles to be washed within the wash chamber. The washing machine also includes at least one processing device that is configured for determining whether effluent from a rinse cycle contains fabric softener; and, using the effluent in a rinse cycle of the washing machine if fabric softener is present.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
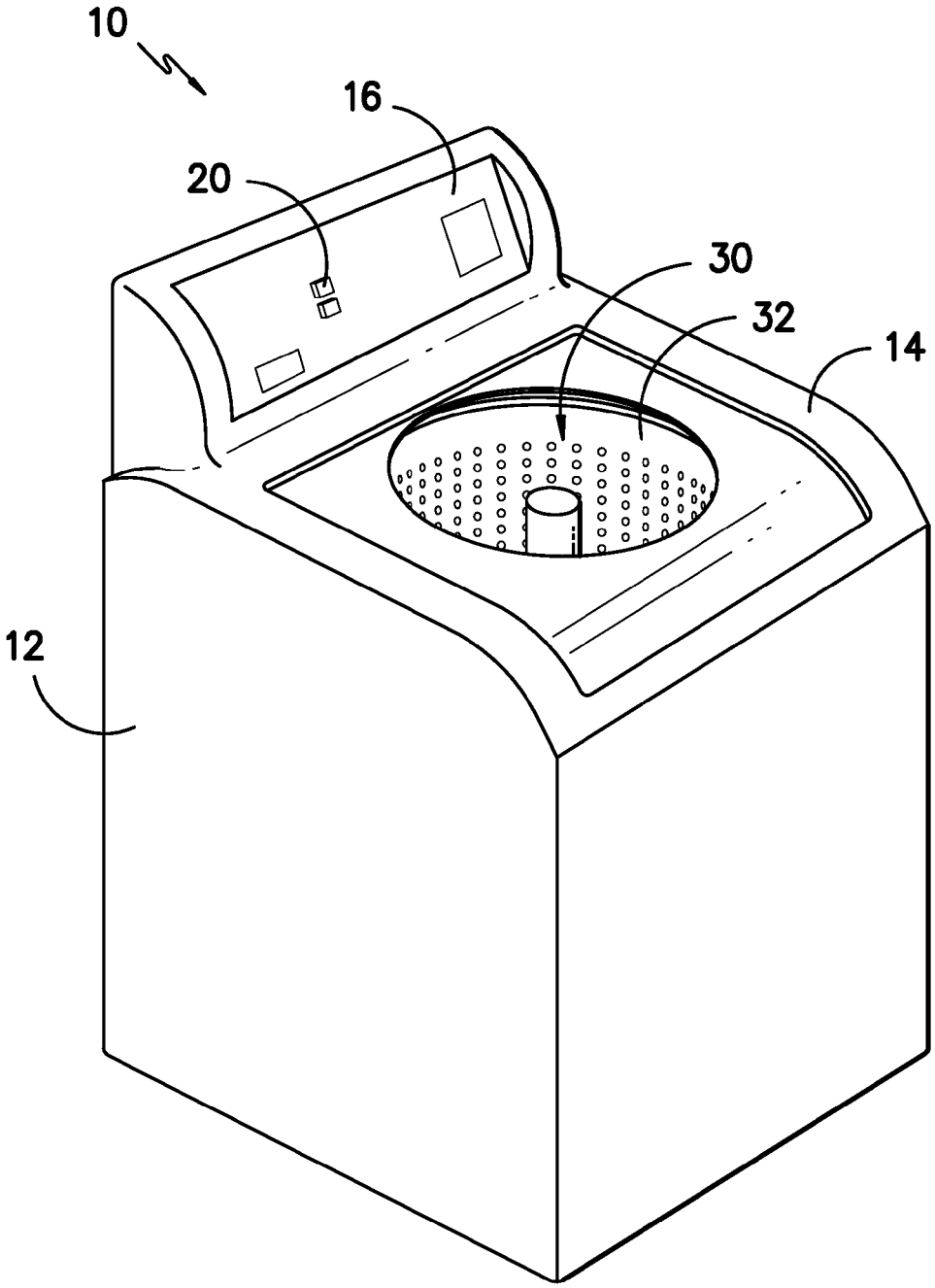
FIG. 1 provides a perspective view of an exemplary vertical axis washing machine as may be used with the present invention.

The present invention relates to the capture and reuse of the effluent, or grey water, from the rinse cycle of a washing machine appliance. A determination is made regarding whether fabric softener is present in the effluent. If fabric softener is present, then the effluent can be reused during a rinse cycle of the washing machine so as to avoid undesirable interaction between the fabric softener in the effluent and the detergent of a rinse cycle. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to fabrics, textiles, garments (or clothing), and linens. Furthermore, the term "load" or "wash load" refers to the combination of articles that may be washed together in a washing machine and may include a mixture of different or similar articles of different or similar types and kinds of fabrics, textiles, garments and linens within a particular laundering process. The term "water" is intended to broadly refer to a liquid phase used during a "wash cycle" or "rinse cycle" of a laundering process. "Grey water" or "effluent" refers to water that was previously used in a wash or rinse cycle and, therefore, may contain detergents and/or fabric softener. "Fresh water" refers to water that does not contain detergents or fabric softener from a previous wash or rinse cycle.

The term "wash cycle" is intended to refer to one or more periods of time, in which a washing machine that contains the articles to be laundered operates using a detergent and water, preferably with agitation to e.g., remove dirt and odors from the articles. The term "rinse cycle" is intended to refer to one or more periods of time in which the washing machine operates to remove residual detergents that were retained by the articles after completion of the wash cycle. The term "first rinse cycle" refers to the first cycle after a wash cycle, where water (fresh water or effluent) is added in order to help remove detergent from the articles. The term "spin cycle" is intended to refer to one or more periods of time during which the washing machine rotates the articles so as to create centrifugal forces to remove water, typically grey water or effluent, from the article after a wash or rinse cycle. As used herein, the terms "laundering" or "laundering cycle" refers to an article cleaning process by which articles to be cleaned are exposed to one or more cleaning agents and to rinsing. The laundering process typically includes at least one wash cycle, rinse cycle, and spin cycle, and may include multiple such cycles in various combinations.

Figure 2:
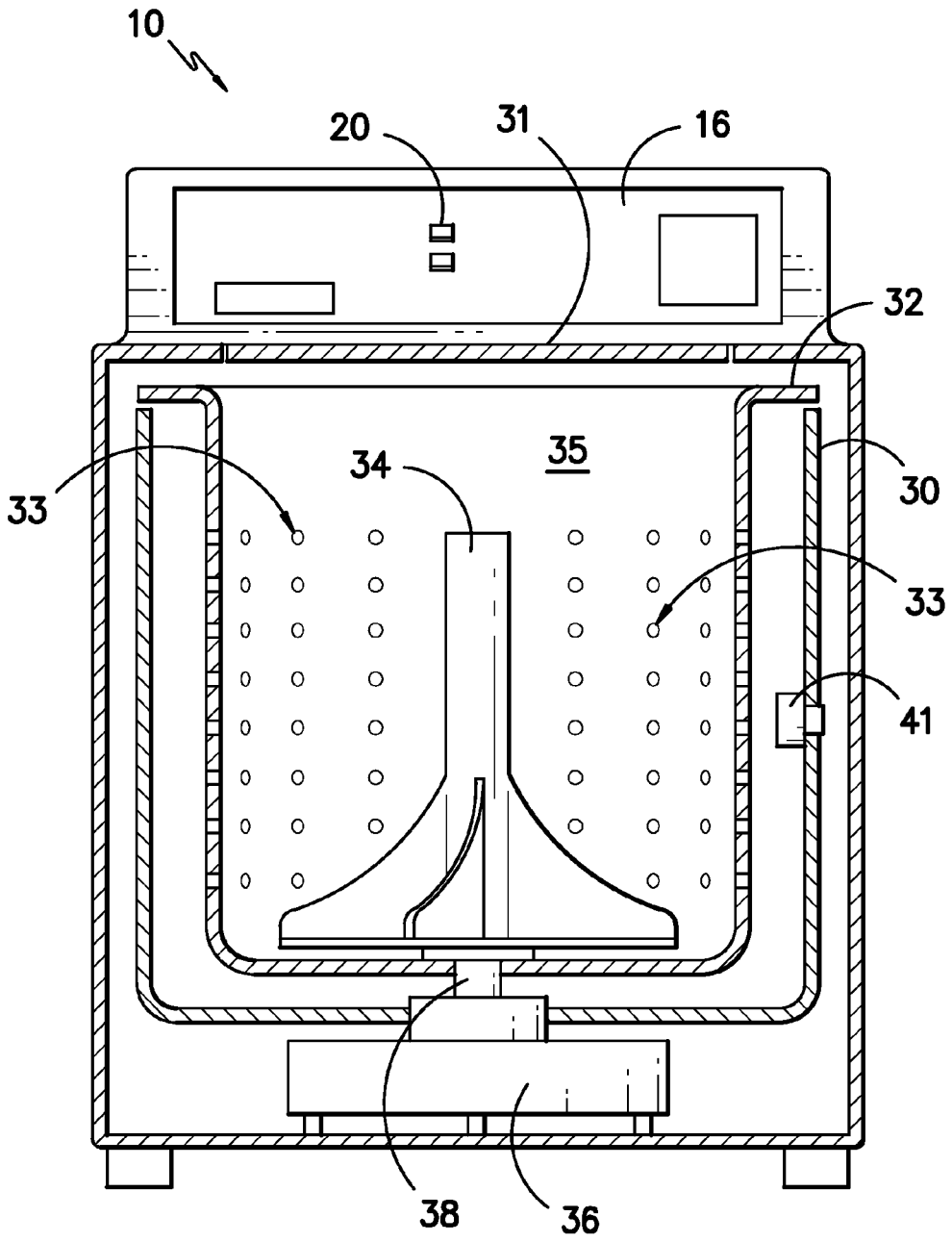
FIG. 2 is a cross-sectional view of the exemplary washing machine of FIG. 1.

FIG. 1 is a perspective view of an exemplary vertical axis washing machine 10 that includes a cabinet 12 having a cover 14. FIG. 2 provides a cross-sectional view of the machine 10 of FIG. 1. A backsplash 16 extends from cover 14, and a variety of appliance control input selectors 20 are coupled to backsplash 16. Input selectors 20 form a user interface for operator selection of washing cycles and features. For clarity of illustration, a door 31 is not shown in FIG. 1 so that the interior of machine 10 is visible—door 31 is shown in cross-section in FIG. 2.

A wash chamber 30 is located within cabinet 12, and a wash basket 32 is rotatably mounted within wash chamber 30 in a spaced apart relationship from wash chamber 30. Basket 32 includes a plurality of perforations 33 therein to facilitate fluid communication between the interior 35 of basket 32 and wash tub 30. An agitator, impeller, or oscillatory basket mechanism 34 is disposed in basket 32 to impart an oscillatory motion to articles and liquid in basket 32. Agitator 34 is provided by way of example only; other configurations for agitation may be used including e.g., fins on basket 32 or other configurations as well. Motor 36 provides for the movement of agitator 34 through connection by shaft 38. Wash chamber 30 is also in fluid communication with one or more pumps and/or drains for the removal of water, such as grey water, from chamber 30 such as e.g., after a wash or rinse cycle.

Washing machine 10 is controlled by a processing device or other controller, such as a microprocessor (not shown), according to user preference via manipulation of control input selectors 20 mounted on backsplash 16. As used herein, processing device may refer to one or more microprocessors or semiconductors devices and is not restricted necessarily to a single element. The processing device can be programmed to operate washing machine 10 according to the exemplary aspects of the present invention as set forth below.

As illustrated in FIG. 1, agitator 34 is oriented to rotate about a vertical axis. It is contemplated, however, that benefits of the present invention can apply to horizontal axis washing machines as well. More specifically, the washing machine of FIGS. 1 and 2 is provided by way of example only. Using the teachings disclosed herein, one of ordinary skill in the art will understand the present invention may be used with washing machines of various other configurations in both residential and commercial applications.

Figure 3:
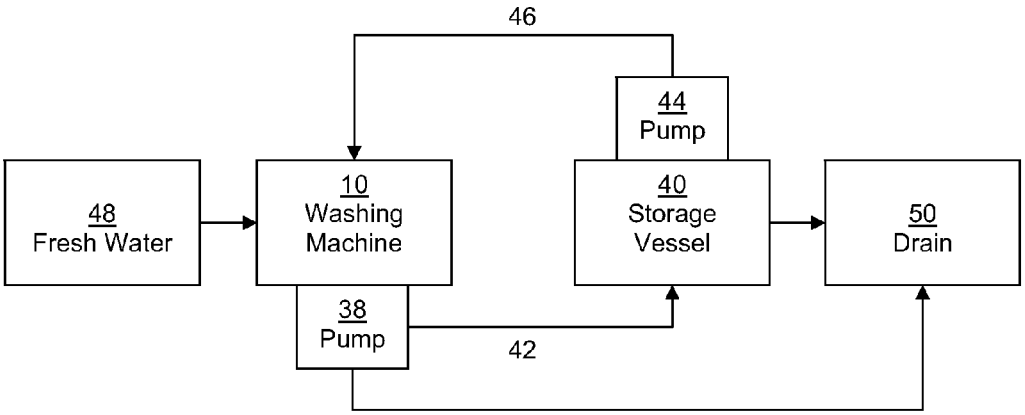
FIG. 3 provides a schematic representation of a washing machine system as may be used with the present invention.

A variety of embodiments whereby washing machine 10 is equipped to capture effluent (i.e. grey water) from the rinse cycle may be applied. An exemplary embodiment will now be described—it being understood that the present invention is not limited to such configuration as others may be used as well. As shown schematically in FIG. 3, washing machine 10 could be connected with a storage tank 40 for holding effluent that has been removed from wash chamber 30. Storage tank 40 may be located within machine 10 or may be external thereto. For example, washing machine 10 could include a pump 38 and be connected by piping or tubing 42 to holding tank 40. Upon completion of a rinse cycle, pump 38 can be activated by e.g., the processing device to transport effluent from wash chamber 30 of machine 10 to holding tank 40. Similarly, tank 40 may include a pump 44 for the movement of effluent by tubing 46 back to washing machine 10. FIG. 3 is provided by way of example only. With appropriate valving, the same pump and tubing could be used to transport effluent back and forth between washing machine 10 and tank 40. Other configurations may be used as well.

If desired, filtration devices could be added to remove certain materials from the effluent. For example, a particulate filter like a polypropylene canister filter or bag type filter that would remove suspended particles may be employed. Other types of filtration media such as clay or activated carbon can be used to remove the organics in the water including dyes, oils, surfactants, etc. Still other types of filtration types such as membrane filtration including ultra-filtration, nano-filtration and reverse osmosis can also be used to remove nearly any dissolved solid including fabric softener ingredients depending on the media chosen.

Washing machine 10 is also connected with a supply of make-up, fresh water 48—i.e., non-grey water that can also be used to fill machine 10 or supplement effluent from tank 40. Washing machine 10, tank 40, or both may also be connected to a drain 50.

Figure 4:
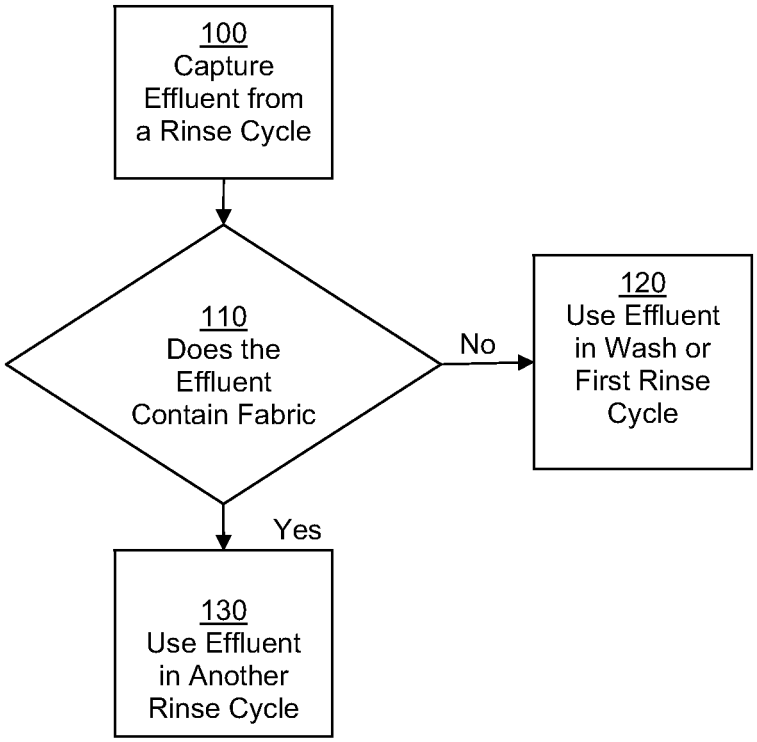
FIGS. 4-6 are flowcharts setting forth exemplary methods of the present invention for operation of a washing machine.

Using a flow chart, FIG. 4 sets forth an exemplary method for operation of washing machine 10 according to the present invention. In step 100, effluent (i.e. grey water) from the rinse cycle of washing machine 10 is captured for reuse later in a subsequent cycle of the machine. This may be accomplished, for example, using the exemplary system set forth in FIG. 3 or other configurations as well.

Once the effluent from a rinse cycle has been captured in step 100, a determination is made in step 110 regarding whether the captured effluent contains fabric softener. A variety of techniques may be employed for step 100. By way of example, if washing machine 10 includes an automatic dispenser for the delivery of fabric softener, the processing device of machine 10 can check to see if the user selected this option for the rinse cycle from which the effluent was captured. Accordingly, the processing device will "know" that the effluent captured in step 100 contains fabric softener. For example, the processing device can store this information until the captured effluent is to be reused in a rinse cycle.

Alternatively, some washing machines may be equipped with trays or cups that serve as fabric softener dispensers (not shown). The fabric softener is added manually by the user into such dispensers at e.g., the beginning of the laundry cycle. During the rinse cycle, these dispensers are activated to release fabric softener into the wash load. For these types of washing machines, the fabric softener dispenser can be equipped with a sensor that determines whether fabric softener has been added by the user for the rinse cycle. Several types of sensors could be employed including, for example, a level sensor, an electrical conductivity sensor, and other types as well. If the sensor detects fabric softener, a signal is transmitted to the processing device of washing machine 10 that provides a notification that fabric softener was used. Accordingly, when the effluent from the rinse cycle containing fabric softener is captured for reuse in a subsequent rinse cycle, the processor will "know" that the effluent contains fabric softener.

In still another example, washing machine 10 can also be equipped with a sensor 41 that is present in wash tub 30. Sensor 41 determines whether fabric softener is present in within tub 30 during a rinse cycle. For example, sensor 41 could be constructed from a surface tensiometer. If sensor 41 detects fabric softener, a signal is transmitted to the processing device of washing machine 10 providing a notification that fabric softener was used. Accordingly, when the effluent from the rinse cycle containing fabric softener is reused in a subsequent rinse cycle, the processor will "know" that the effluent contains fabric softener.

The above techniques for executing step 110 to determine if fabric softener is present in effluent from a rinse cycle are provided by way of example only. Other techniques may also be employed as will be understood by one of ordinary skill in the art using the teachings disclosed herein.

If step 110 determines that the effluent captured from a previous rinse cycle does not contain fabric softeners, then in step 120 that effluent can be used in either a wash cycle or another rinse cycle. More specifically, because the effluent does not contain fabric softener, there is no concern for an improper interaction with the laundry detergent of the wash cycle. Accordingly, the captured effluent may be used in either a wash cycle or a rinse cycle as in step 120.

However, if step 110 determines that fabric softener is present in the effluent captured from a rinse cycle as in step 100, then it is desirable to avoid using the effluent in a wash cycle of washing machine 10 because of the unwanted interaction between the laundry detergent of wash cycle and the fabric softener present in the effluent as previously described. Accordingly, if fabric softener is present, then the effluent is used only in another rinse cycle of washing machine 10 as set forth in step 130.

If used in a rinse cycle, preferably the effluent is used in a first rinse cycle as previously defined. More specifically, washing machine 10 may actually employ several rinse cycles for a given wash load. In order to ensure that the fabric softener is properly rinsed from the clothes, preferably the effluent is used in the first rinse cycle. It should also be understood that in the event the amount of captured effluent is not sufficient to provide all of the fluid needed for the rinse cycle, additional fresh water can be added into the wash tub 30 along with effluent so that a proper amount of rinse fluid is provided. In an alternative embodiment, a sensor could be used to determine whether the amount of fabric softener present in the captured effluent is less than a certain predetermined level. If so, the captured effluent could be used in a second or final rinse cycle instead of only in the first rinse cycle. In addition, a turbidity sensor could be placed in wash tank 30 and/or holding tank 40 to determine whether the captured effluent is clear enough (e.g., below a predetermined NTU) to use as a second or final rinse.

Figure 5:
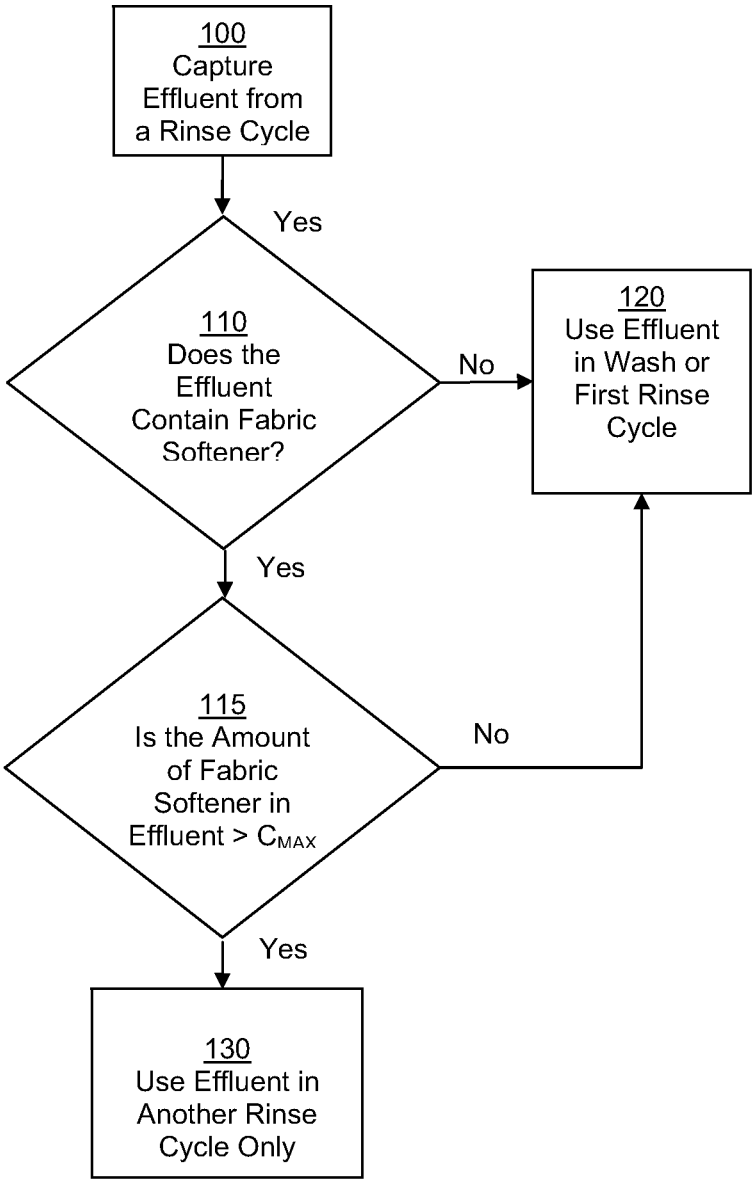

FIG. 5 provides another flow chart to illustrate an exemplary method of the present invention. Steps 100, 110, and 120 are as previously described with regard to FIG. 4. However, unlike FIG. 4, if fabric softener is present in the captured effluent, an additional step is undertaken in step 115 to determine the amount of fabric softener present. More specifically, $C_{MAX}$ represents a value for the amount of fabric softener at which an undesirable effect on the laundry detergent in a wash cycle would occur if the effluent captured in step 100 was used in the wash cycle. $C_{MAX}$ can be, for example, a maximum concentration as measured by a sensor or could be a maximum overall amount of fabric softener present in the wash load. Regardless, a determination is made as to whether this threshold value of $C_{MAX}$ is exceeded by the current level of fabric softener in the effluent captured in step 100. For example, sensor 41 or a sensor in storage vessel 40 may provide the processing device with a measurement of the amount of fabric softener. The processing device then compares this measurement with $C_{MAX}$.

If the amount (or concentration) of fabric softener is less than $C_{MAX}$, then the captured effluent can be reused in a wash cycle or a rinse cycle in washing machine 10. As stated previously, preferably the rinse cycle is a first rinse cycle. Alternatively, if the amount (or concentration) of fabric softener is greater than $C_{MAX}$, then the captured effluent can be reused only in a rinse cycle in washing machine 10. Alternatively, the effluent may be treated to reduce or remove the amount of fabric softener to below $C_{MAX}$, and the effluent may then be used in a wash cycle in the washing machine 10. In this way, undesirable interactions between the laundry detergent in a wash cycle and the fabric softener are avoided.

Figure 6:
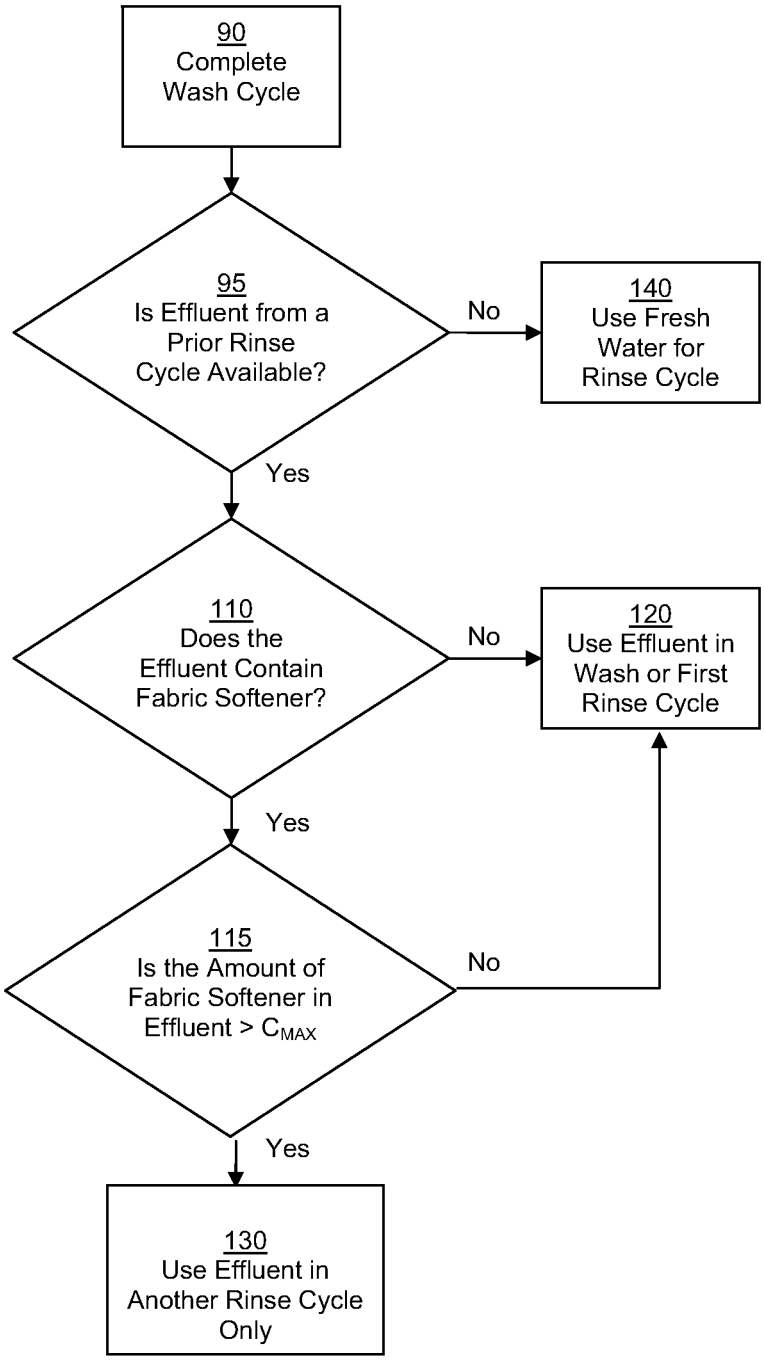

Another exemplary method for operating washing machine 10 is set forth in FIG. 6. Steps bearing the same reference numerals as FIGS. 4 and 5 are executed as previously described. However, during the operation of washing machine 10 between multiple laundry cycles, there may be times at which effluent from a prior rinse cycle is unavailable. Accordingly, after a wash cycle is completed in step 90, the processing device determines if effluent from prior rinse cycle is even available in step 95. For example, a sensor is storage vessel 40 may provide a signal to the processing device of washing machine 10 indicating whether effluent previously captured from a rinse cycle (as in step 100 of FIGS. 4 and 5) is available. If such effluent is available, then steps 110 and higher can be executed as previously described. If such effluent is not available, then the processing device can provide a signal to use fresh water in the rinse cycle of washing machine 10 as set forth in step 140.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a washing machine, comprising the steps of:

capturing an effluent from a rinse cycle of a washing machine;

determining an amount of fabric softener present in the effluent;

determining whether the effluent contains a threshold amount of fabric softener;

using the effluent in a wash cycle of the washing machine only if the effluent contains less than the threshold amount of fabric softener; and utilizing the effluent in another rinse cycle of a subsequent washing operation if the effluent contains more than the threshold amount of fabric softener.

2. A method for operating a washing machine as in claim 1, wherein said step of utilizing the effluent in the another rinse cycle comprises introducing the effluent in a first rinse cycle.

3. A method for operating a washing machine as in claim 1, further comprising the step of treating the effluent to reduce or remove the amount of fabric softener if the effluent contains more than the threshold amount of fabric softener.

4. A method for operating a washing machine as in claim 1, wherein said step of determining whether the effluent contains the threshold amount of fabric softener comprises checking whether a user of the washing machine selected an option for automatic dispensing of fabric softener.

5. A method for operating a washing machine as in claim 1, wherein said step of determining whether the effluent contains the threshold amount of fabric softener comprises using a sensor to determine if fabric softener is present in the effluent.

6. A method for operating a washing machine as in claim 1, wherein said step of determining whether the effluent contains the threshold amount of fabric softener comprises measuring the concentration of surfactant present in the effluent.

7. A method for operating a washing machine as in claim 1, wherein said step of determining the amount of fabric softener present in the effluent comprises measuring the amount of surfactant present in the effluent, and wherein said step of determining whether the effluent contains the threshold amount of fabric softener comprises comparing the concentration of surfactant present in the effluent to the threshold amount.

* * * * *